US010955167B2

(12) United States Patent
Bannish et al.

(10) Patent No.: US 10,955,167 B2
(45) Date of Patent: Mar. 23, 2021

(54) AIRFOIL BLADE AND METHOD OF ASSEMBLY

(71) Applicant: MESTEK, INC., Westfield, MA (US)

(72) Inventors: John Bannish, Granville, MA (US); Jim Monahan, West Springfield, MA (US)

(73) Assignee: Mestek, Inc., Westfield, MA (US)

( * ) Notice: Subject to any disclaimer, the term of this patent is extended or adjusted under 35 U.S.C. 154(b) by 0 days.

(21) Appl. No.: 16/234,931

(22) Filed: Dec. 28, 2018

(65) Prior Publication Data

US 2019/0242614 A1 Aug. 8, 2019

Related U.S. Application Data

(63) Continuation-in-part of application No. 15/000,678, filed on Jan. 19, 2016, now Pat. No. 10,208,982.

(60) Provisional application No. 62/106,868, filed on Jan. 23, 2015.

(51) Int. Cl.
*F24F 13/15* (2006.01)
*F24F 13/14* (2006.01)

(52) U.S. Cl.
CPC ..... *F24F 13/15* (2013.01); *F24F 13/14* (2013.01); *F24F 13/1406* (2013.01); *F24F 13/1426* (2013.01)

(58) Field of Classification Search
CPC ..... F24F 13/15; F24F 13/10; F24F 13/1413; F24F 13/14
USPC ..... 454/336, 335; 160/236
See application file for complete search history.

(56) References Cited

U.S. PATENT DOCUMENTS 2,643,627 A 6/1953 Wobbe
3,908,529 A * 9/1975 McCabe ..... F24F 13/1406 454/359
4,382,460 A * 5/1983 Ben-Tal ..... E06B 7/084 160/236

OTHER PUBLICATIONS

Canadian Office Action dated May 24, 2019 issued in corresponding CA Patent Application No. 2,974,659.

* cited by examiner

*Primary Examiner* — Vivek K Shirsat
(74) *Attorney, Agent, or Firm* — Grogan, Tuccillo & Vanderleeden, LLP

(57) ABSTRACT

An airfoil blade assembly includes an upper airfoil shell, and a lower airfoil shell and a pair of upper legs protruding from the upper airfoil shell and extending towards the lower airfoil shell. A pair of lower legs protrudes from the lower airfoil shell and extending towards the upper airfoil shell and are formed by bending material of the lower airfoil shell back upon itself. An upper strengthening rib formed is in the upper airfoil shell, and a lower strengthening rib is formed in the lower airfoil shell. The pair of upper legs and the pair of lower legs are abutting when the upper airfoil shell and the lower airfoil shell are selectively fixed to one another.

3 Claims, 5 Drawing Sheets

AIRFOIL BLADE AND METHOD OF ASSEMBLY

CROSS REFERENCE TO RELATED APPLICATIONS

The present application is Continuation-in-Part of U.S. utility patent application Ser. No. 15/000,678 filed on Jan. 19, 2016, which itself claims priority to U.S. provisional application Ser. No. 62/106,868, filed on Jan. 23, 2015, each of which are hereby incorporated by reference in their entirety.

FIELD OF THE INVENTION

The present invention relates to dampers and, more particularly, to an airfoil blade for a damper and a method of assembling an airfoil blade.

BACKGROUND OF THE INVENTION

Dampers have long been used in a variety of fluid handling applications to control the flow of various types of fluids. Typical uses of industrial dampers include the handling of process control fluids, the handling of fluids in power plants, and the handling of high speed fan discharge streams. Industrial dampers are usually subjected to relatively high pressures and must have considerable strength in order to be capable of withstanding the forces that are applied to them.

The damper construction normally includes a rigid frame which defines a flow passage controlled by a plurality of damper blades that each pivot between open and closed positions about a respective axle. The blades are often interconnected by a linkage which moves all of them in unison to control the fluid flow rate in accordance with the damper blade position. Although flat damper blades are often used, it has long been recognized that airfoil shapes can be used to enhance the fluid flow. Airfoil blades are thickest in the center at the pivot axis and taper toward each edge to present an aerodynamically efficient shape which minimizes turbulence and other undesirable effects such as noise generation and stresses on the flow passage and other components of the fluid handling system.

In the past, damper blades have been formed by bending multiple sheets of steel and joining them together to form an airfoil shape. Typically, in a separate step, a bead of silicone or other sealant may be manually deposited at the respective ends of each blade to provide for an air tight seal between the damper blades when in a closed position. In a further separate step, a bracket is mounted to each end of the blade, which is necessary to locate and accommodate an axle on which each blade pivots. As will be readily appreciated, however, existing airfoil blades are very time consuming and tedious to manufacture, requiring numerous and separate manual steps. In addition, existing blades often require additional strengthening ribs to bolster the blade under high speed flow, which may further increase the cost and labor involved.

Accordingly, it is desirable to provide an airfoil blade assembly that is easier, more cost effective, and less labor-intensive to produce than existing blades.

SUMMARY OF THE INVENTION

According to the present invention, an airfoil blade assembly includes a first shell member having a body having a first lock seam formed at one end thereof and a free distal end opposite the first lock seam, and a second shell member having a body having and a second lock seam formed at one end thereof and an a free distal end opposite the second lock seam. The second shell member is inverted with respect to the first shell member. The free distal end of the first shell member is captured within the second lock seam of the second shell member and the free distal end of the second shell member is captured within the first lock seam of the first shell member to lock the blades to one another.

According to another embodiment of the present invention a method of assembling an airfoil blade includes roll forming first and second shell members of the airfoil blade on a roll forming machine and depositing a sealant bead in an end seam of each of the shell members on the roll forming machine in an inline process. The method also includes joining two shell members to one another and crimping respective ends of each shell member to form a lock seam which captures a free edge of the opposed shell member therein to lock the shell members to one another.

According to yet another embodiment of the present invention, a damper assembly is provided. The damper assembly includes a frame, an axle rotatably mounted to the frame, and an airfoil blade assembly operatively mounted to the axle. The airfoil blade assembly includes an upper shell member and a lower shell member, wherein said lower shell member is invertedly disposed and connected to said upper shell member.

DETAILED DESCRIPTION OF PREFERRED EMBODIMENTS

Figure 2:
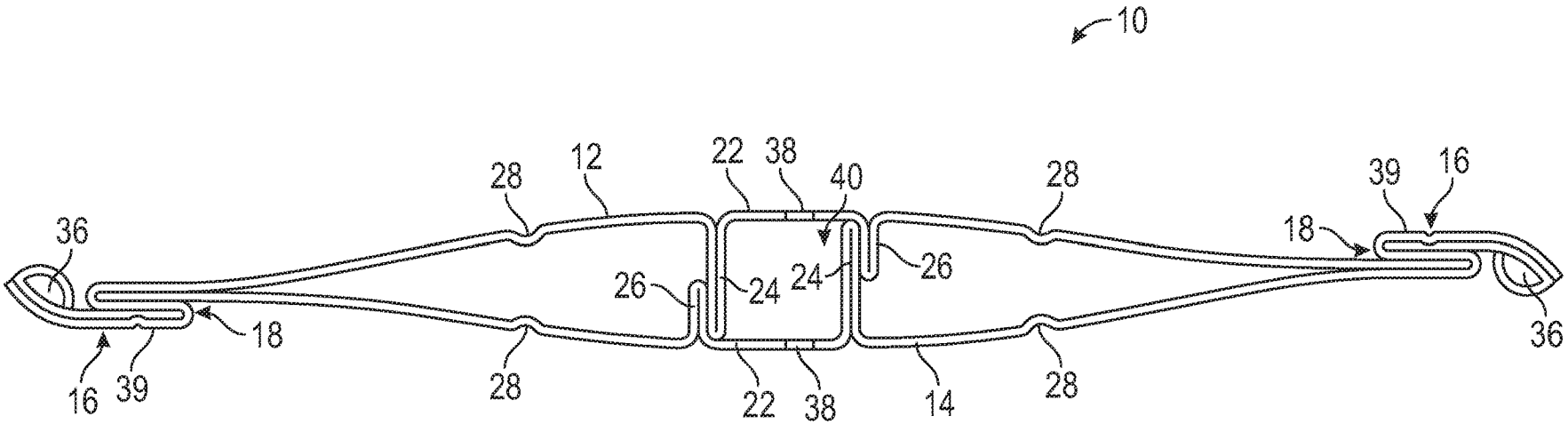
FIG. 2 is a cross-sectional view of an airfoil blade constructed according to an embodiment of the present invention.

With reference to the drawings, reference numeral 10 generally designates an airfoil blade constructed in accordance with the present invention. With particular reference to FIG. 2, the airfoil blade is formed from a pair of relatively thin shell members 12, 14 which themselves may be formed from galvanized steel sheets. Each of the sheets is initially flat, and the sheets are bent into the shapes shown by suitable roll forming techniques. As illustrated in FIG. 2, the shell members 12, 14 are substantially identical and are manufactured in the same manner. As also shown therein, the upper shell member 12 essentially mirrors the lower shell member 14, to which it is interconnected in the manner discussed hereinafter.

Each shell member 12, 14 includes an end seam 16 at one end thereof which is bent back upon the body of the respective shell member 12, 14 to provide a lock seam 18 which captures the free side edge 20 of the opposed shell member 12, 14. By capturing the free side edges 20, the two shell members 12, 14 are rigidly interlocked along both of their side edges 20. The edges of the blade 10 are parallel.

The airfoil blade 10 has a hollow airfoil shape best shown in FIG. 2. The shell members 12, 14 form the walls of the blade 10, and the shell members 12, 14 converge toward the interlocked edges to give the blade 10 a tapered profile. Center portions 22 of the respective upper and lower shell member 12, 14 are spaced apart from one another to provide the center portion of the blade 10 with a predetermined thickness. The blade 10 gradually tapers from the center portion toward each of the opposite edges.

Figure 3:
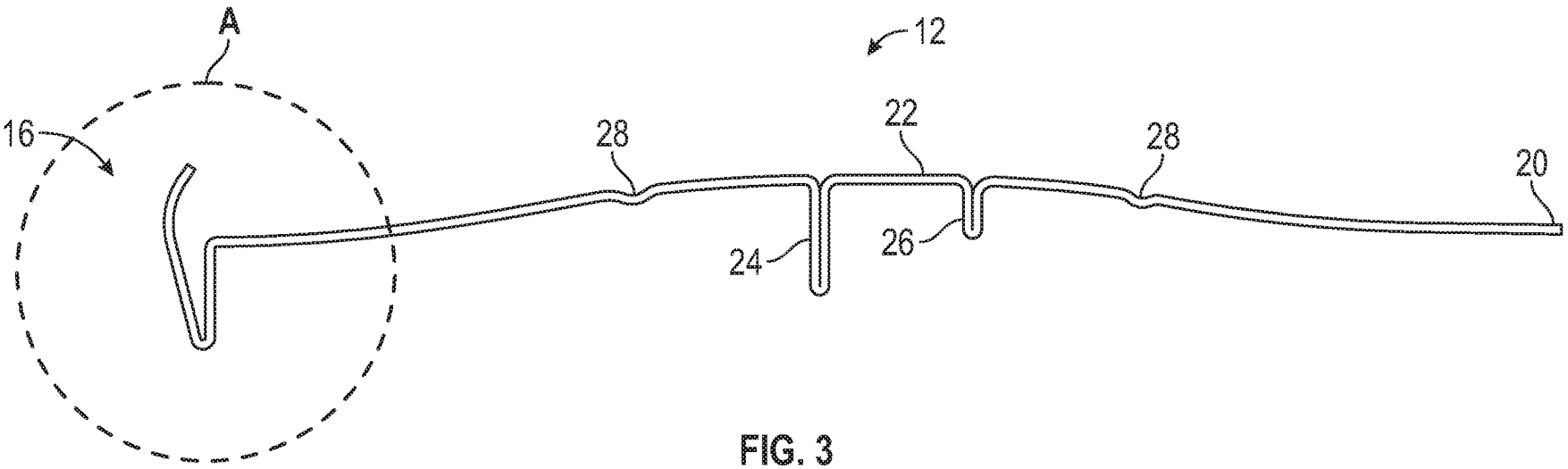
FIG. 3 is cross-sectional view of a shell member of the airfoil blade of FIG. 2.

Turning now to FIG. 3, a cross-sectional view of shell member 12 is illustrated. Shell member 14 is substantially identical to shell member 12 and is manufactured in a substantially identical manner, however only shell member 12 is being shown for clarity. As discussed above, shell member 12 may be formed from a sheet of galvanized steel in a roll forming operation.

The shell member 12 includes a first edge having a generally V-shaped end seam 16 and an opposed free edge 20. The shell member 12 is generally arcuate in shape and has a center portion 22. On opposing sides of the center portion 22, downwardly depending legs are formed by bending the sheet of material back upon itself. In particular, a first depending leg or seam 24 is formed between the end seam 16 and the center portion 22 and a second depending leg or seam 26 is formed between the center portion and the free edge 20. As shown, the height of the first depending leg 24 is greater than the height of the second depending leg 26. The shell member 12 also includes a pair of spaced apart strengthening ribs 28 formed in the body of the shell member 12 adjacent to the center portion 22 and outside the legs 24, 26, respectively. The ribs 28 are formed by corrugations in the shell member 12 and serve as stiffeners which enhance the strength of the airfoil blade 10. Each rib 28 has a V-shaped configuration and extends into the interior of the blade 10.

As therefore shown in FIGS. 2 and 3 in total, the legs 24 and 26 of each shell 12/14 of the airfoil blade assembly 10 are preferably formed to be unequal in length so as to avoid any undesirable and damaging material deformation that can occur to the metal blank should the roll forming process that forms the airfoil blade assembly 10 be required to form both legs, 24 and 26, to each be as long as the first depending leg 24.

Moreover, by having legs 24 and 26 be of differing lengths, the assembly process is streamlined, whereby installers in the field can easily arrange the two halves/shells 12/14 of the airfoil blade assembly 10 in their proper orientation merely by ensuring that the shorter of the two legs, leg 26, is always located on the outside of each of the legs 24 (as best seen in FIG. 2).

It will therefore be readily appreciated that by forming legs 24 and 26 to be of uneven lengths the present invention ensures against material deformation, as well as providing a visual and structural guide for the final assembly of the airfoil blade 10.

It will also be readily appreciated that the arrangement of legs 24 and 26 are such that, when shell 12 and shell 14 are mated to one another, each of the shorter legs 26 provides a significant strengthening and stiffening capability to the longer legs 24. In just this fashion, the present invention provides the structurally robust, axially-aligned center portion 22, as shown best in FIG. 2. In this regard, it is envisioned that leg 24 and 26 are generally formed to be unequal in length, preferably formed such that the shorter leg 26 is substantially half the length of the longer leg 24, and more preferably that leg 24 is at least one third the length of leg 24.

Known airfoil blade assemblies typically require the addition of one of more separate structures within the airfoil blade assembly to support an axial control rod disposed for movement of the airfoil blade assembly. In contrast, the present invention has recognized that by forming the structurally robust and axially-aligned center portion 22 via the nesting of legs 24 and 26, it is possible to use these inner legs 24/26 to also provide the housing for any axial control rod disposed therein, without the use of any additional structure to the interior of the airfoil blade assembly 10.

Indeed, as will be appreciated by one of ordinary skill, not only do the strengthening legs 24 and 26 of the present invention provide structural support for the airfoil blade assembly 10 as a whole, but by virtue of the nature of their construction, the legs 24 and 26 also provide a robust anchor point for any axial control rod disposed therein and used to move the airfoil blade assembly 10 between open and closed positions.

Still further, the structure of the center portion 22 of the airfoil blade assembly 10 is such that, as opposed to known axial control rods that extend the entire axial length of known airfoil blade assemblies, the current invention permits the use of shortened axial control rods which need only to be captured within the control portions 22 formed on distal ends of the assembled airfoil blade assembly 10. Thus, robust nature of the center portion 22, flowing from the structure and orientation of the legs 24 and 26, promotes efficiency and reduces manufacturing costs by allowing shortened axial control rods to be used adjacent each distal end of the airfoil blade assembly 10 instead of longer, heavier and more expensive continuous rods running the axial length of the airfoil blade assembly, as is commonly known in the art.

Figure 4:
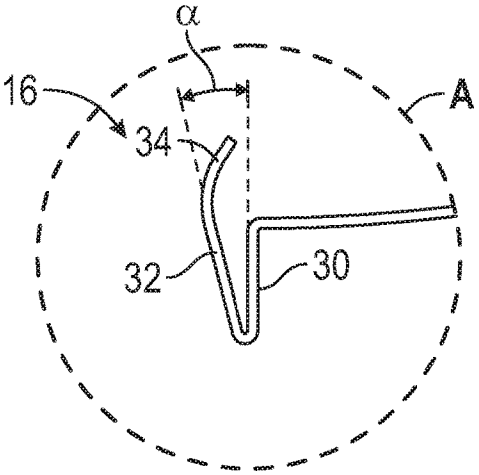
FIG. 4 is an enlarged, detail view of area A of FIG. 3.

As shown in FIGS. 3 and 4, the end seam 16 is generally V-shaped and has a first leg portion 30 that extends from the shell member body at a substantially ninety-degree angle, a second leg portion 32 that extends from the first leg portion 30 to form an angle, $\alpha$, therebetween, and an arcuate tail portion 34 that extends from the second leg portion 32 over the open end of the end seam 16. In an embodiment, the angle, $\alpha$, is between approximately 10 and 20 degrees and, more preferably, is approximately 15 degrees.

Figure 5:
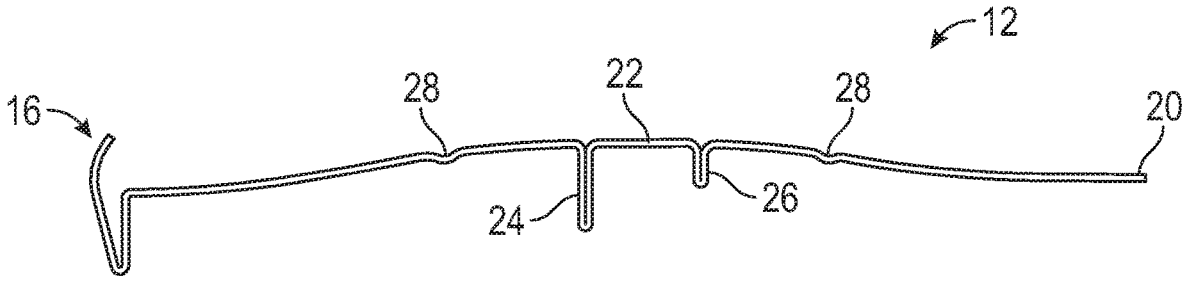
FIG. 5 is a cross-sectional view of the shell member of FIG. 3 after a roll forming operation.
Figure 6:
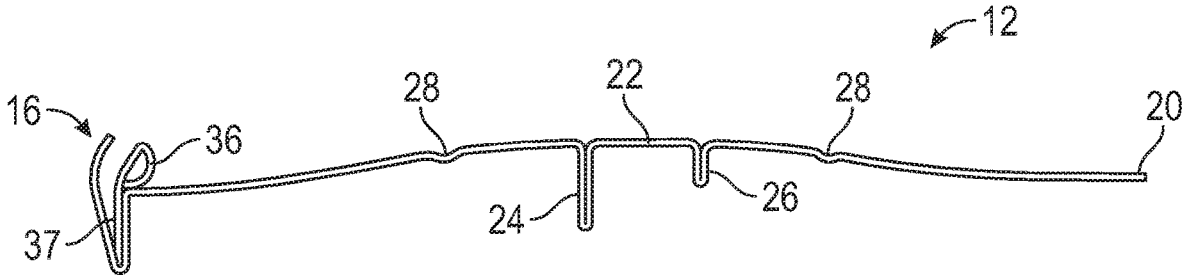
FIG. 6 is a cross-sectional view of the shell member of FIG. 3, illustrating the insertion of a silicone bead in an end seam of the shell member.

With reference to FIGS. 5-10 assembly of the airfoil blade 10 utilizing shell members 12, 14 is illustrated. As best shown in FIG. 5, shell member 12, and the end seam 16, strengthening ribs 28, depending legs 24, 26 and center portion 22 thereof, are formed by repetitively bending, or roll forming, the sheet material on a single roll forming machine.

Figure 7:
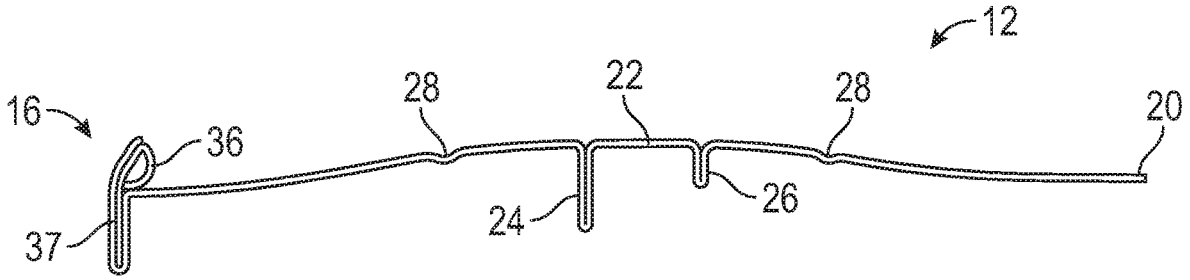
FIG. 7 is a cross-sectional view of the shell member of FIG. 3 after the end seam is closed.

As the shell member 12 is suitably formed to the desired shape, and concurrent to the ongoing roll forming process, a bead of sealant 36, such as silicone or vinyl, is then disposed along the length of the shell member 12 within the end seam 16. Importantly, the sealant 36 is deposited in the end seam 16 as part of an in-line manufacturing process on the same roll forming machine on which the shell member 12 is formed. The same roll forming machine is then utilized to close the end seam 16, as illustrated in FIG. 7.

As also shown in FIGS. 5-10, the bead of sealant 36 includes a tail 37, captured within the seam 16, further assisting in locating and fixing the bead of sealant 36 along the lateral edge of the airfoil blade assembly 10. Indeed, as perhaps best seen in FIG. 2, seam 16 further includes an inwardly deformed locking tab 39, further arresting the sealant bead 36 from undesirable movement or dislocation.

As will be readily appreciated by a review of FIGS. 2 and 5-10, the bead of embedded sealant 36 is not positioned or intended to prevent the entrance of moisture of contaminants into the body of the airfoil blade assembly 10 itself. Instead, the sealant bead 36 of the present invention is left exposed to run continuously along the lateral edge of, for example, each of the airfoil blade assemblies 10 shown in FIG. 1. As will therefore be readily appreciated, when the individual airfoil blade assemblies 10 are moved to their 'closed' position (they are shown in their 'open' position in FIG. 1), the lateral edge of their respective planar faces will come into contact with the lateral edge of each adjacent airfoil blade assemblies. Thus, as will be appreciated, the sealant bead 36 disposed along each lateral edge of each of the airfoil blade assemblies 10 will become trapped between adjacent airfoil blade assemblies, thereby providing an elastic and resilient sealing member between such adjacent blade assemblies.

In stark contrast, known airfoil blade systems mechanically attach sealing members to the airfoil blade assemblies after the roll forming process is concluded, thus increasing the complexity, cost and manufacturing time of the resultant airfoil blade assembly. It is therefore an important aspect of the present invention that not only is the sealant bead 36 applied during the roll forming process, but it is done such that a portion/tail of the sealant bead is captured within a sealing seam already formed adjacent each lateral edge of the airfoil blade assembly 10, thereby saving manufacturing costs and time.

Figure 8:
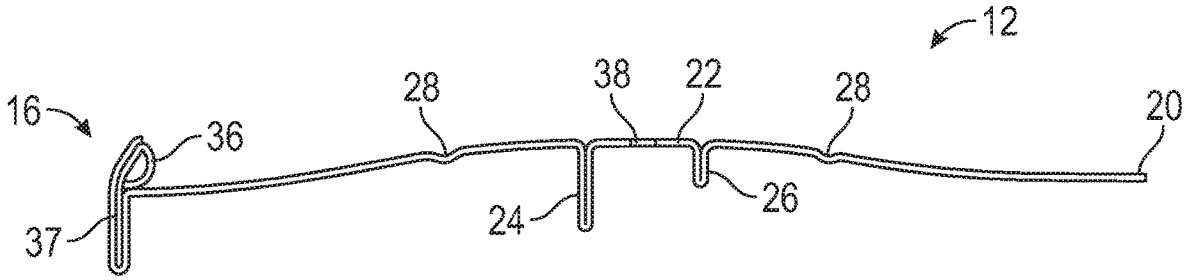
FIG. 8 is a cross-sectional view of the shell member of FIG. 3 after the shell member has been cut to length and locating apertures are punched in the shell member.

The shell member 12 is then cut to a desired length, and apertures 38 are pierced in shell member 12 in the center portion 22 at cutoff, as shown in FIG. 8. In an embodiment, the apertures 38 are located approximately 1.25 inches from the leading and trailing edges of each shell member 12 (i.e., from the left and right edges of a completed shell member). Importantly, the formation of the shell members 12, deposition of the sealant in the end seam 16, closing of the end seam 16, piercing of the apertures 38 and cutting the shell members 12 to the desired length is accomplished on a single machine without necessitating intervention or manipulation by an operator or technician. In an embodiment, the shell members 12, 14 are cut to a length of between approximately 8 inches and 60 inches, although the shell members 12, 14 may be cut to any length to form a blade assembly 10 having any desired span.

Figure 9:
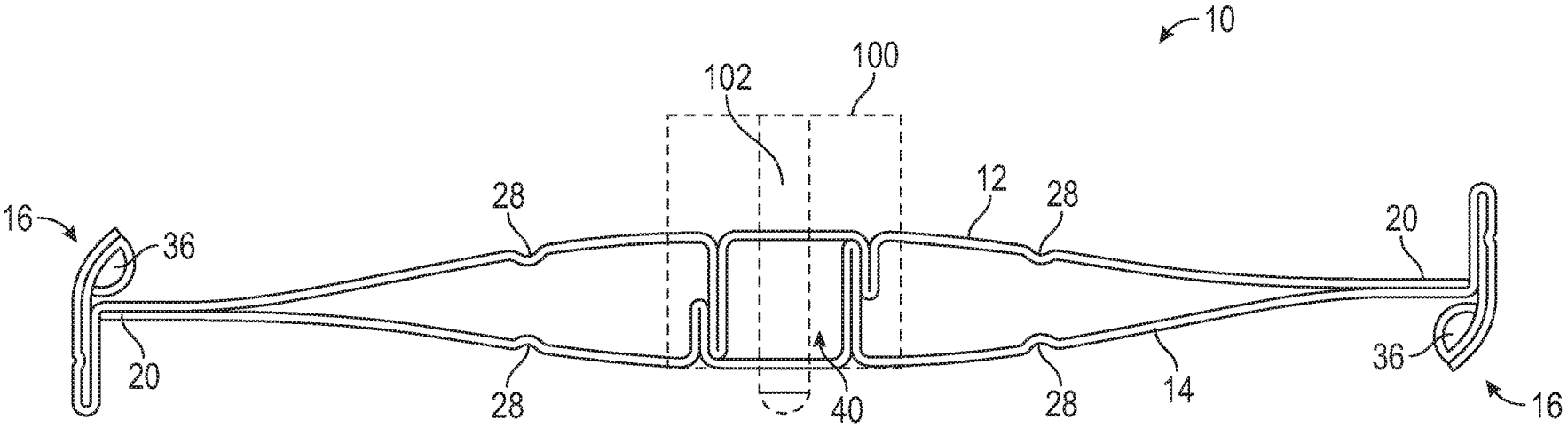
FIG. 9 is a cross-sectional view of the airfoil blade of FIG. 2, illustrating the joining of two shell members to one another.

Once multiple shell members 12 are produced, an operator will collect the shell members 12. One shell member is then flipped over on its backside (e.g., shell member 14 in FIG. 9). A mating shell member 12 is then placed directly on top of shell member 14, as shown in FIG. 9. A pin fixture 100 having pins 102 may then be placed on each end such that pins 102 extend through the apertures 38 in both shell members 12, 14 to properly locate and align the shell members, 12, 14 with one another. The airfoil blade 10 is then transferred to a bending/joining apparatus where the end seams 16 of each shell member 12, 14 are bent towards the center portion 22 (to close the ninety-degree bend between the shell member body and the first leg portion 30 of the end seam 16). This bending operation forms lock seams 18 which capture the free edges 20 of the opposed shell member 12, 14 therein.

This formation of the lock seams 18, and capturing the free edges 20 of the corresponding shell member 12, 14, respectively, therein, serves to lock the shell members 12, 14 to one another to form the completed airfoil blade assembly 10. The pin fixtures 100 may then be removed and reused in the assembly of another airfoil blade. The completed airfoil blade assembly 10 is illustrated in FIG. 2. As shown, the sealant beads 36 are located on opposed edges (front and back), and opposed sides (upper and lower) of the blade assembly 10. In an embodiment, the sealant beads 36 may be formed from silicone where the intended use for the damper blades 10 is in fire dampers. In other embodiments, the sealant bead may be formed from other materials, such as vinyl and the like, without departing from the broader aspects of the present invention.

Importantly, as best illustrated in FIG. 2, the opposed depending legs 24, 26 of each shell member 12, 14 define a longitudinal passageway or channel 40 for the passage of an axle, as hereinafter described. In particular, as shown in FIG. 2, the longer, first depending legs 24 extend from the shell member body from which they are formed substantially to the blade body of the opposed shell member. The shorter, second depending leg 26 of each shell member is configured to lie outside the first depending leg 24 of the opposing shell member, and functions to provide bolstering support for the first depending legs 24, as illustrated in FIG. 2 (i.e., the second legs 26 buttress the first legs 26). In this manner, the bolstering legs 26 help to maintain the structural rigidity of the first depending legs 24, thereby maintaining the integrity and square form of the channel 40 during operation. Moreover, the four standing seams (i.e., the first and second depending legs 24, 26 of each shell member 12, 14) provide strength to the completed blade assembly 10 and provide a pocket for the axle, as discussed hereinafter. Accordingly, there is no need to utilize a separate bracket to locate the axle, which eliminates many of the tedious steps required for existing methods of assembly.

Figure 1:
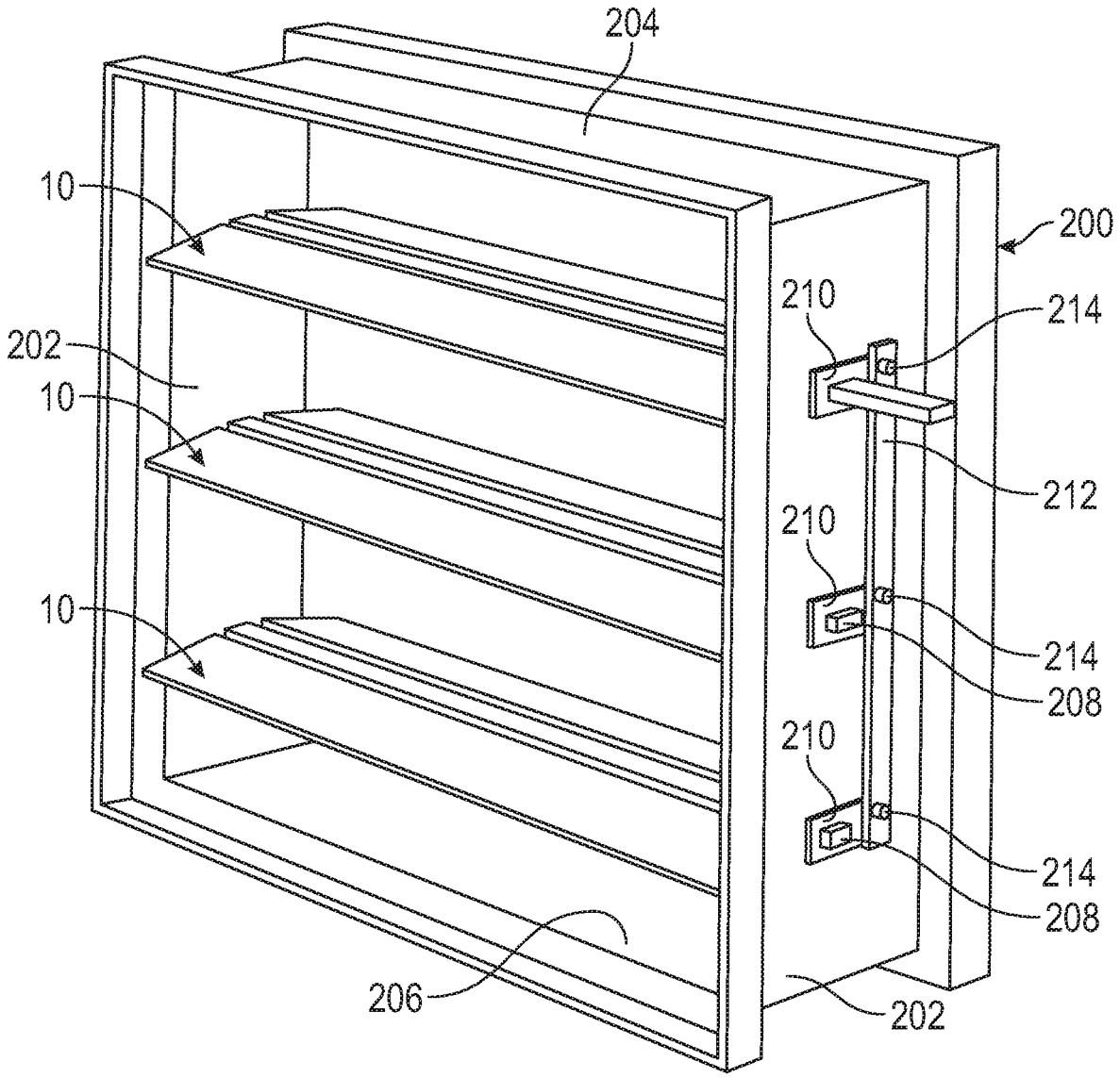
FIG. 1 is a schematic illustration of a flow control damper equipped with airfoil blades in a fully open position.

Referring to FIG. 1, once the airfoil blade assemblies 10 are constructed in the manner hereinbefore described, they may be dropped, one by one, into a rigid damper frame 200 having opposite sides 202, a top portion 204, and a bottom portion 206. The frame 200 is normally installed in a fluid flow passage, a portion of which is formed by a damper opening 216 presented within the frame 200 between the sides and the top and bottom of the frame.

The axle 208 for each blade may then be slid through the frame 200 and through the channel 40 within each blade assembly 10. In an embodiment, the axle may have a cross-section that is substantially similar to the square cross-section of the channel 40, at least along the longitudinal extent where the axle is received within the channel 40. In an embodiment, the axles 208 may be approximately ½" in thickness and have a square cross-section. The axles 208 are supported for pivotal movement on the opposite sides 202 of the frame 200. In particular, the axles 208 may be supported by round bushings that are themselves fixed in the frame 200. As will be readily appreciated, the axle channel 40 formed in the blade assembly 10 keeps the blades from twisting on the axles under torque.

Each axle 208 may be rigidly connected to a crank arm 210, and all of the crank arms 210 may be connected by a vertical linkage 212 pivoted at 214 to the crank arms 210. This arrangement pivots the blade assemblies 10 in unison between the fully opened positioned shown in FIG. 1 and the fully closed position in which the blades 10 are oriented vertically to close the damper opening. Other means of linking the axles 208 so that the blades 10 may be opened or closed in unison may also be utilized without departing from the broader aspects of the present invention. The damper blades 10 can be positioned anywhere between the fully opened and fully closed positions.

As discussed previously, and due to the provision and configuration of the depending legs 24, 26, the need to utilize separate hardware to locate, secure and align each axle within each blade assembly 10 may be obviated. This eliminates costly and tedious manufacturing steps. The configuration of these legs 24, 26 also adds strength to the blade assembly 10 in comparison to existing blades. In addition, by roll forming the shell members and depositing the sealant bead 38 as part of an inline manufacturing process on a single machine, manufacturing efficiency and cost reductions may therefore be realized.

The enhanced stiffening of the center portion of the blade 10 provided by the legs 24, 26 and the ribs 28 eliminates the need to add separate reinforcement tubes or other reinforcement members. Because of the enhanced strength and resistance to deflection provided by the legs 24, 26 and ribs 28, the sheet members 12 and 14 can be relatively light gauge sheet metal so that both the cost and the weight of the damper are reduced without sacrificing strength or other desirable performance characteristics. For example, acceptable results can be obtained from the use of 20 gauge coil stock, although other sheet thicknesses may also be utilized.

Also, as an alternative to utilizing a continuous axle 208 running from the center portion 22 adjacent one distal end of the airfoil blade assembly 10 to the center portion 22 adjacent the opposing distal end of the airfoil blade assembly 10, the configuration of the center portion 22 of the present invention permits the use of two separate and non-continuous axle control rods, each captured with the distally located control portions 22 of the airfoil blade assembly 10, thus reducing the material cost, weight and complexity of the airfoil blade assembly 10 of the present invention.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. An airfoil blade assembly, comprising:

an upper airfoil shell having a first free edge and defining a first bent portion;

a lower airfoil shell having a second free edge and defining a second bent portion, wherein said first free edge is selectively captured within said second bent portion, and wherein said second free edge is selectively captured within said first bent portion, thereby fixing said upper airfoil shell and said lower airfoil shell to one another;

a first sealant bead deposited along said first bent portion, and a second sealant bead deposited along said second bent portion; and wherein said first sealant bead and said second sealant bead remain exposed when said upper airfoil shell and said lower airfoil shell are selectively fixed to one another.

2. A method for forming an airfoil blade assembly, said method comprising the steps of:

roll forming a metal blank to define an airfoil blade shell having a free edge and a bent portion, said bent portion defining a seam;

depositing a bead of sealant into said seam during said roll forming; and forming said bead of sealant to ensure that a portion of said bead remains exposed along a lateral edge of said airfoil blade shell.

3. An airfoil blade assembly, comprising:

an upper airfoil shell having a first free edge and defining a first bent portion;

a lower airfoil shell having a second free edge and defining a second bent portion;

a first sealant bead deposited along said first bent portion;

a second sealant bead deposited along said second bent portion;

a pair of upper legs protruding from said upper airfoil shell, said pair of upper legs being formed by bending material of said upper airfoil shell back upon itself;

a pair of lower legs protruding from said lower airfoil shell, said pair of lower legs being formed by bending material of said lower airfoil shell back upon itself;

an upper strengthening rib formed in said upper airfoil shell, said upper strengthening rib being formed by deforming said material of said upper airfoil shell;

a lower strengthening rib formed in said lower airfoil shell, said lower strengthening rib being formed by deforming said material of said lower airfoil shell;

wherein said first free edge is selectively captured within said second bent portion, and wherein said second free edge is selectively captured within said first bent portion, thereby fixing said upper airfoil shell and said lower airfoil shell to one another;

wherein said pair of upper legs and said pair of lower legs are abutting when said upper airfoil shell and said lower airfoil shell are selectively fixed to one another; and, wherein said first sealant bead and said second sealant bead remain exposed when said upper airfoil shell and said lower airfoil shell are selectively fixed to one another.

* * * * *